United States Patent [19]

LeBlanc

[11] Patent Number: 4,517,781

[45] Date of Patent: May 21, 1985

[54] APPARATUS AND PROCESS FOR PLACEMENT OF PREFABRICATED STRUCTURES

[76] Inventor: J. T. LeBlanc, P.O. Box 17501, Baton Rouge, La. 70893

[21] Appl. No.: 481,343

[22] Filed: Apr. 1, 1983

[51] Int. Cl.[3] ..... E02D 27/42; E04G 21/00

[52] U.S. Cl. ..... 52/299; 52/745

[58] Field of Search ..... 52/745, 64, 263, 299, 52/301

[56] References Cited

U.S. PATENT DOCUMENTS

| | | | |
|---|---|---|---|
| 880,243 | 2/1908 | Rominger | 52/301 |
| 2,245,318 | 6/1941 | Blank | 52/64 |
| 4,064,668 | 12/1977 | Carter | 52/263 |
| 4,319,374 | 3/1982 | Schambeck | 52/745 |
| 4,442,651 | 4/1984 | Cappe | 52/745 |

*Primary Examiner*—James L. Ridgill, Jr.
*Attorney, Agent, or Firm*—Bode & Smith

[57] ABSTRACT

An apparatus and process for placement of prefabricated buildings at onsite foundations, by providing a plurality of prefabricated foundation piers secured to individual concrete footings via bolting or the like. Foundation piers would be spaced apart in order to accommodate the length of the trailer or the like, in pairs, the distance apart substantially equal to the double spanning beams along the length of the trailer. There is further provided an angle iron collar positioned on the first and last pairs of piers, for securing wooden or the like tracks spanning the entire length of the piers, with the tracks attached to the angle iron collar on the first and last set of piers via screwing or the like. There is further provided a single length of angle iron secured to the track, preferably on the inside of each track, to serve as a guide means in the utilization of the track.

Following the placement of the track and guide upon the piers, and assuring that the entire assemblage is level along its entire length, a house trailer or similar structure is slidably placed in position along the double tracks and secured in place.

7 Claims, 5 Drawing Figures

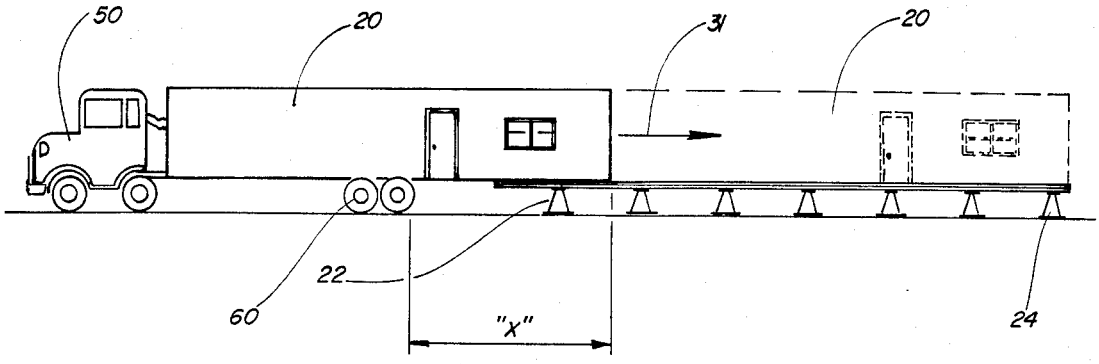
FIG. 4
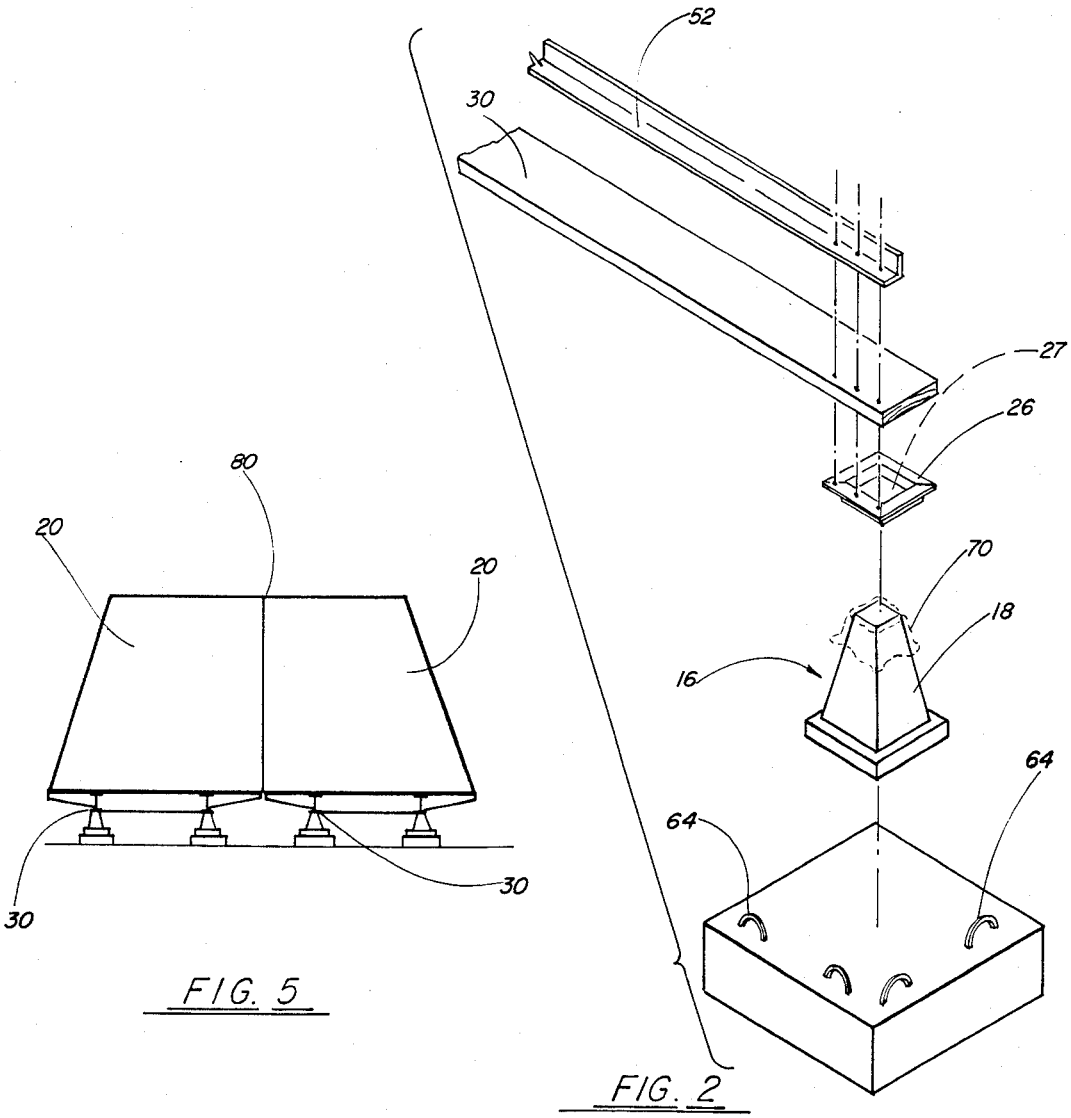
FIG. 5
FIG. 2

APPARATUS AND PROCESS FOR PLACEMENT OF PREFABRICATED STRUCTURES

BACKGROUND OF THE INVENTION

1. Field of the Invention

The apparatus and process of the present invention relates to foundations for prefabricated building and the like. More particularly, the apparatus and process of the present invention relates to placement of prefabricated buildings upon preconstructed foundations whereby the building is delivered to the site and tracked into position upon the foundation piers.

2. General Background

In the construction industry, there is a broad use of prefabricated structures which are basically constructed off site and delivered to the site for utilization. As an example, one of such structures would be a house trailer, which, is as widely known, would be delivered to the site, carried on wheeled axles and pulled by the use of a truck. Once in position, the foundation or piers upon which the trailer shall be set, are then placed into position beneath the trailer, and built up so that the trailer is supported by the piers as a foundation. Oftentimes, in order to accomplish this, in addition to assuring that the trailer is substantially stable and level, "shims" are usually utilized in conjunction with the piers so that the trailer can be secured relatively stable.

This particular means of positioning prefabricated buildings and particularly house trailers, fall short in many respects. Initially, once the trailer or the like has been "rolled" into position, workers must begin the placement of support piers underneath the trailer itself, and accomplish the task of building the foundation up against the trailer while the trailer is in position. This requires very tedious and time consuming work. Likewise, since it is virtually impossible to have the trailer rest directly on the piers, placement of shims must be accomplished also. Although shims, once in place, serve to steady and level the placement of the trailer on the piers, over a period of time, some of the shims are often knocked out of place, the result being that the trailers are left to become unstable and unlevel, of course, resulting in unsuitable living or working conditions.

Therefore, the present state of the art in placement of prefabricated buildings, constructed off site, and delivering to the onsite, falls very short of providing a simplified yet unique apparatus and method for placement of the buildings onto the foundation. The present invention serves to overcome these problems.

GENERAL DISCUSSION OF THE PRESENT INVENTION

The process and overall apparatus utilized by the present invention solves the shortcomings as found in the present state of the art in a simple and straightforward manner. What is provided is an apparatus and process for placement of prefabricated buildings at onsite foundations, by providing a plurality of prefabricated foundation piers secured to individual concrete footings via bolting or the like. Foundation piers would be spaced apart in order to accommodate the length of the trailer or the like, in pairs, the distance apart substantially equal to the double spanning beams along the length of the trailer. There is further provided an angle iron collar positioned on the first and last pairs of piers, to serve as a means for securing wooden or the like tracks spanning the entire length of the piers, with the tracks attached to the angle iron collar on the first and last set of piers via screwing or the like. There is further provided a single length of angle iron secured to the track, preferably on the outside of each track, to serve as a guide means in the utilization of the track.

Following the placement of the track and guide upon the piers, and assuring that the entire assemblage is level along its entire length, a house trailer or the like is placed thereupon which for the most part, are constructed on a plurality of steel cross beams secured to a pair of "I" beams extending their entire width, with left/right outrigger portion spanning total width of the trailer. The distance between the longitudinal "I" beams would be, in the preferred embodiment, equal to the distance between the tracks, so that the trailer, could be backed up to the tracted piers, and the trailer longitudinal "I" beams would be initially positioned on the tracks. Following this, the truck would slidably track the trailer along the longitudinally disposed beams with the exterior angle iron guides maintaining the "I" beams in position along the length of the track. The tires and axles would then be removed from the house trailer, so that the trailer would be supported at one end by the truck cab, and on the second end by the tracked piers, and the truck would have the ability to continue to push the trailer along the tracked piers until the entire length of the trailer is secure on the piers, and the trailer could then be disconnected from the truck, and would be in position on the piers.

There is further provided anchor loops embedded within the concrete footings, to more firmly secure the trailer to the footings in addition to the "I" beams having a continuous foundation track to be supported upon. There could be further provided a second pair of piers adjacent the first pair so that a second trailer could be placed in position adjacent the first trailer to serve as a single unit in the case of the event a larger prefabricated unit were to be utilized.

Therefore, it is an object of the preferred embodiment of the present invention to provide an apparatus and process for positioning of prefabricated buildings upon foundation piers.

It is a further object of the present invention to provide a process whereby prefabricated buildings could be placed along foundation piers by the use of a track means.

It is a further object of the present invention to provide an apparatus and process whereby the foundation constructed together with the prefabricated building serves to work in conjunction with the piered foundation and sliding the prefabricated building into position along the piered foundation.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and, wherein:

FIG. 2 is an exploded view of the preferred embodiment of the apparatus utilized in the process of the present invention;

FIG. 4 is a side overall view of the preferred embodiment of the process of the present invention; and FIG. 5 is an end view of the apparatus and process of the present invention illustrating prefabricated buildings in position.

DETAILED DESCRIPTION OF THE PREFERRED EMBODIMENT

For a proper explanation of the preferred embodiment of the present invention, a reference shall be made to FIGS. 1 through 5 as illustrates the utilization of the process in conjunction with the apparatus of the present invention, as it would pertain to house trailers. It should be noted that although these particular illustrations, in FIGS. 1 through 5 are illustrative of the utilization of the process and apparatus with house trailers, this process and apparatus could be utilized in various types of prefabricated buildings, with the apparatus simply constructed as the particular building would be utilizing various types of foundation configurations, as long as the integrity of the process and apparatus were maintained.

Figure 1:
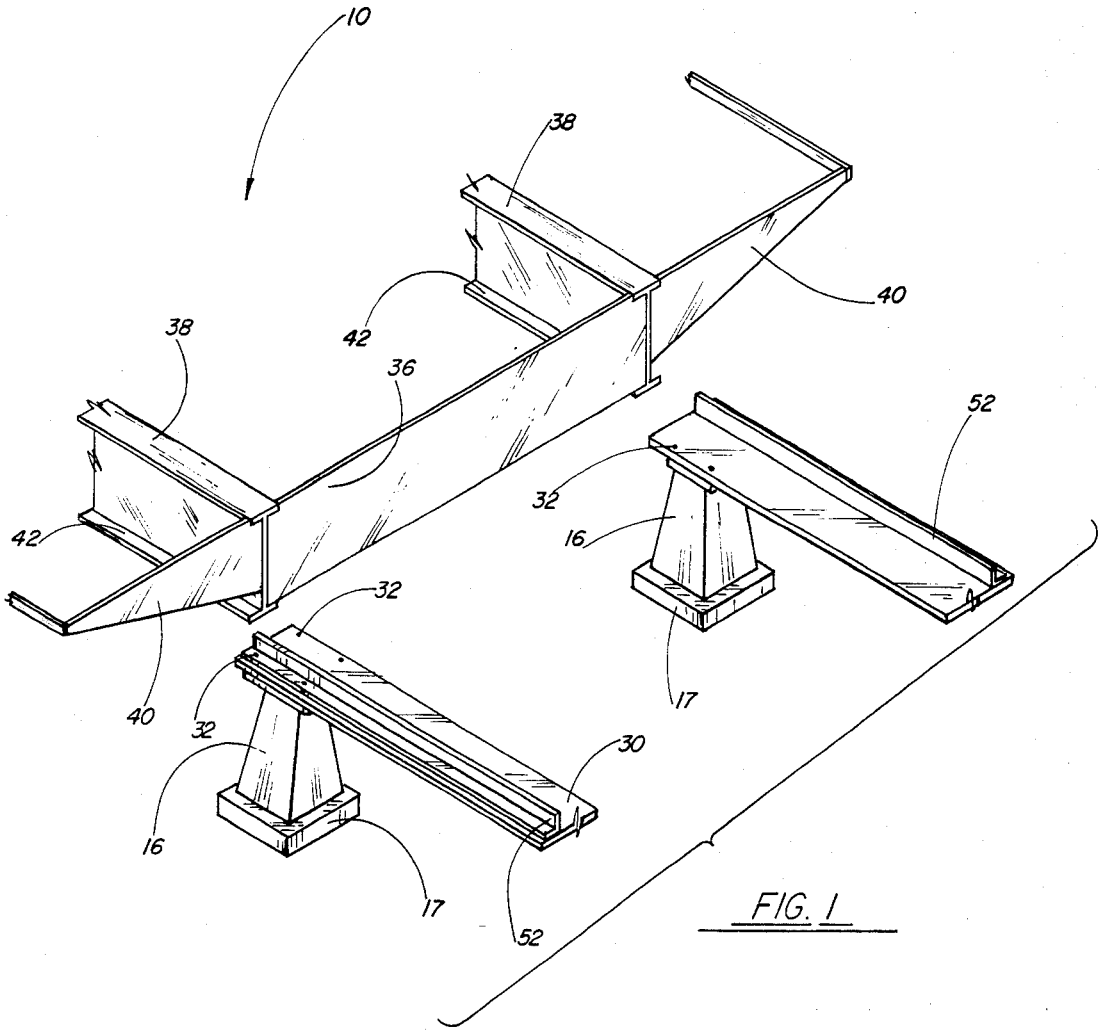
FIG. 1 is a partial perspective view of the preferred embodiment of the apparatus utilized in the method of the present invention.
Figure 3:
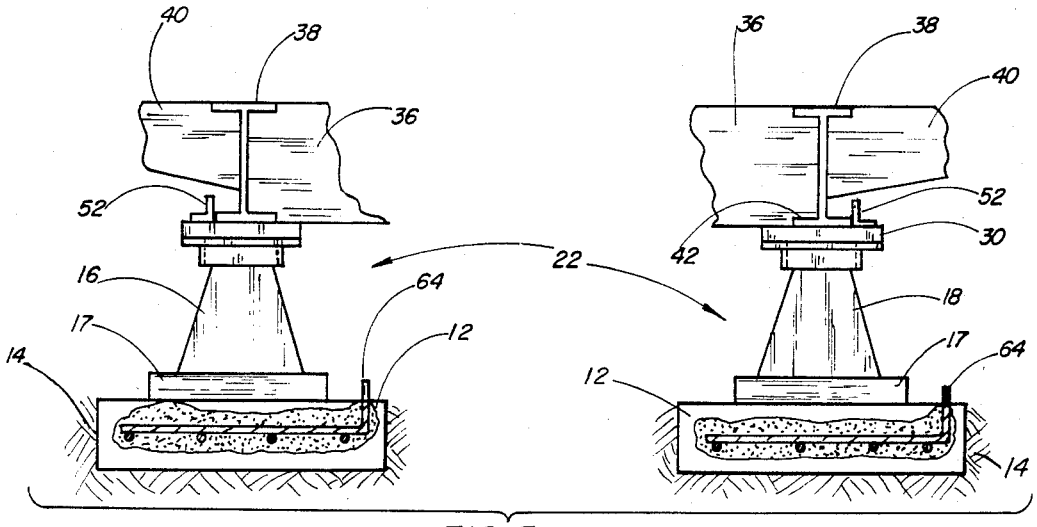
FIG. 3 is an end view of the preferred embodiment of the apparatus utilized in the process of the present invention.

Therefore, FIGS. 1 through 5 illustrate the preferred embodiment of the apparatus as utilized with house trailers as in numeral 10. As was stated earlier, in order to accomplish the process of the present invention, apparatus 10 has to be in position for the trailer or the like being delivered to site. In order to accomplish this end, there would first be provided a plurality of concrete footings 12 which would be standard concrete footings placed as a base within the surrounding ground 14, with the individual concrete footing 12 functioning as a support base for the individual pier members 16 which shall be placed thereupon. In the preferred embodiment, as is illustrated in FIGS. 1 through 4, pier member 16 would be the typical concrete or the like pier member, pyramid in shape having base plate 17 tapering into reduced top portion 18. In the preferred embodiment, pier member 16 would be positioned on each individual support base 12, and would be secured thereto via bolting or the like. Because one of the primary functions of this particular system is to assure that the entire foundation is level for positioning of trailer 20 thereupon, once in the position support base 12 in conjunction with pier 16 serve to function as a plurality of base members substantially equal and level in height for supporting the further components of the system thereto (see FIG. 4). In that regard, as is illustrated in the FIGURES, following the securing of the plurality of pier members 16 upon the individual base members 12, in the particular embodiment for accomodating the house trailer, the base members and individual pier member 16 thereupon would be aligned in the double row as seen in FIGS. 1 and 3, with pairs of pier members 16 existing in pairs along the entire length of the foundation system. In the preferred embodiment, the initial pair 22 of pier members 16 at the first end of the foundation system and the last pair of pier members 24 (not shown) at the second end of the system, would be particularly suited to accommodate the foundation assemblage as follows. As is illustrated in exploded view in FIG. 2, each of said pier members or foundation means 16 in pairs 22 and 24 would be adapted with, at its uppermost end 18 an angle iron collar 26, which would be comprised of four sections of angle iron forming a collar having a opening 27 for placement upon the upper portion 18 of pier 16. In the preferred embodiment, as illustrated in FIG. 4, angle iron collar 26, appearing on first pair of pier members 22 and last pair of pier members 24 would accommodate longitudinal track member 30 which would be constructed of wood or the like, and would be a continuous track longitudinally disposed between pier members 22 through pier members 24 as a double runaway as is illustrated in FIG. 1. In the preferred embodiment each of said track 30 would be boltingly attached to angle iron collar member 26 via bolts 32. Since angle iron collars 26 appear only on the first pair 22 and last pair 24 of piers 16, continuous track members 30 would not be bolted to the intermediate pairs of pier member 16, but would simply rest thereupon for foundation purposes. It is necessary to bolt track 30 to collar 26 so that when track 30 is being utilized, this would prevent any longitudinal or lateral movement of track 30 as the house trailer 20 or the like is being slidably placed thereupon.

As this is seen in FIG. 1, a typical house trailer would have, as its foundation during transport, a plurality of transverse "I" beams 36 spaced, at approximately 48 inches apart along house trailer 20's length each "I" beam 36 expanding substantially across the middle section of the width of trailer 20. Each of said transversely disposed "I" beam 36 would be boltingly attached to pair of longitudinally running "I" beams 38 which, in the preferred embodiment would run along the entire length of house trailer 20, in order to give it the necessary support. Extending outward serving as a continuous support means from each laterally disposed "I" beam 36 would be outriggers 40 which would be boltingly attached to the web portion of "I" beam 38 and extend outwardly to the outside edges of house trailer 20 for complete support of the trailer during transport.

Since, as was stated earlier, house trailer 20, in the present state of the art would normally be supported on a series of piers which would be moved into position after house trailer 20 has been rolled into place, trailer foundation means 33, comprising the I-Beam system, would serve as the support between track 30 and house trailer 20. Therefore, in the present invention, utilizing this same foundation means 33, particularly the longitudinally disposed "I" beams 38, piers 16 set upon footings 12, have been so positioned in pairs so that pairs of track 30 are the identical spacing as the spacing between "I" beams 38, so that the lower flange portions 42 of "I" beam 38 serves as the primary surface of contact with track 30. In the preferred embodiment, "I" beams 38, after making contact with the upper surface of track 30, would define a means to slidably move house trailer 20 onto the support system as defined by the series of pier members 16 in conjunction with track 30. As is seen in FIG. 4, as truck 50 is reversed (arrow 31), house trailer 20, with "I" beams 38 having made sliding engagement with track 30, moves rearedly along double track 30 so that is, once in position will be resting upon the entire length of the support system as shown in phantom view in FIG. 4.

In order to assure that "I" beams 38 do not move out of position as they are glidably moved down track 30, there is further provided longitudinal angle iron 52, which, as seen in FIGS. 2 and 3 is boltingly attached to each track 30 to serve as a guide means for preventing the misalignment of "I" beam 38 along the length of track 30 during the placement process. As is seen in the drawings, angle iron 52 would be boltingly attached at the first pair of pier members 16 to collar 26 and at the last pair of pier member 16. As is seen in FIG. 4, in the transport of trailer 20, there is provided a wheel system 60 which, serves as a rear transport means at the rear end of the trailer while the trailer is attached to the truck at its front end.

As seen in FIG. 4, as the trailer is moving onto the tracking or support system, there will come a point whereby wheels will interfere with the further rearward movement of the trailer down the track as indicated by the letter X. When this occurs, wheel system 60 would be removed from trailer 20, with trailer 20 being supported on its rear end by system 10, and on its front end by truck 50. Following the removal of the wheels, trailer 20 is then allowed to be slid completely onto foundation 30, with truck 50 being disattached, and leaving trailer 20 on the solid foundation as indicated in FIG. 4 in phantom view.

Following the positioning of house trailer 20 on the foundation there is further provided a plurality of anchor means or loops 64 anchored into the base 12, so that support wires or the like can be attached between anchor loops 64 and trailer 20 to serve as an additional means to anchor trailer 20 down on foundation 30.

Again, although this particular embodiment and illustrations in FIGS. 1 through 5 illustrates the use of the system in conjunction with a house trailer, it should again be made clear that this particular system can be used in a variety of uses, including work buildings, various types of prefabricated structures, which must be placed on a raised foundation. Under this particular system, once the measurements between the "I" beams have been obtained, the piers can be positioned such that the system can be used as a track for the "I" beams in the prefabricated building, and the building can simply be slidably positioned onto the foundation.

Further, it should be noted that due to regulations in the building industry, a termite flashplate must be placed between the pier 16 and track 30, in order to avoid damage to the track. This can be done easily in the intermediate pier 16 between pairs 22 and 24. However, for pairs 22 and 24, in the suggested embodiment, a specially designed termite flash guard would be utilized so that angle iron, 26 could be placed onto top portion 18 of pier 16 following the positioning of flash guard 70 as is seen in phantom view in FIG. 2 which is FIG. 3. The flash plate 70 is seen in phantom in FIG. 2, the exploded view.

One of the further unique features of the present system is the fact that it can be utilized in tracking house trailers to be set up in combination in order to establish a larger unit, as seen in FIG. 5. In FIG. 5, there is seen a pair of house trailers 20 which have been tracked onto tracks 30, with each house trailer 20 being placed into position individually under the present system. After both house trailers 20 have been placed in position adjacent one another, they are simply interconnected through conventional means (along line 80), and the single unit is established. Of course in order to accommodate several house trailers, or even more for that matter, it is necessary that the double tracking system 30 be placed for each house trailer 20 and at such a distance apart so as to accommodate the single house trailer, each single house trailer 20 along each set of paired tracks so that once in position the house trailers are able to be interconnected via conventional means.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A process for placement of a prefabricated building having a structural base, which comprises the following steps:

a. providing and securing foundation means to the ground;

b. extending and securing continuous track members as a double runaway longitudinally disposed between said foundation means;

c. providing guide means upon said tracking means for disallowing off-track movement of said building along said tracking means as said building is slid thereupon;

d. partially aligning said structural base on one end of said tracking members; and e. sliding said building along said tracking means from said partially aligned position to a fully aligned position wherein the structural base of said building is resting fully on said tracking members.

2. The method of claim 1, including the additional step of securing said structure on said structural base with the use of anchor means.

3. The process in claim 1, further providing the step of maneuvering said structure from a wheeled vehicle to a position in contact with said tracking means.

4. A foundation apparatus utilized in conjunction with prefabricated structures having a support base integral thereto, comprising:

a. foundation means secured to the ground, comprising a plurality of spaced apart pier members;

b. track members, secured to and resting upon said pier members and extending substantially the length of the prefabricated structure to be placed thereupon;

c. means securing said track means to said pier members; and d. guide means, which comprises a vertically disposed member secured to the upper surface of said track members, said guide means providing a continuous path along said track members for movement of said prefabricated structure upon said track means, as said prefabricated structure is slidably positioned upon said track members from a first partially aligned position wherein the end of said structure is resting on the first end of said track members to a second fully aligned position wherein the support base of said prefabricated structure is resting fully along substantially the length of said track members.

5. The apparatus in claim 4, further comprising means securing said prefabricated structure to said foundation means.

6. The apparatus in claim 4, further providing means positioning at least a pair of prefabricated structures adjacent one another for securing into a single multi-structure.

7. The apparatus in claim 4, wherein said means securing said track to said foundation means comprises a rectangular collar member fittingly engaged along the top portion of each of said pair of pier members.

* * * * *